US006644492B1

(12) United States Patent
Mitchell

(10) Patent No.: US 6,644,492 B1
(45) Date of Patent: Nov. 11, 2003

(54) CONTAINER

(75) Inventor: Paul Bernard Mitchell, Auckland (NZ)

(73) Assignee: Viscount Plastics (NZ) Limited, Mt. Wellington (NZ)

( * ) Notice: Subject to any disclaimer, the term of this patent is extended or adjusted under 35 U.S.C. 154(b) by 0 days.

(21) Appl. No.: 09/890,746

(22) PCT Filed: Feb. 4, 2000

(86) PCT No.: PCT/NZ00/00007

§ 371 (c)(1),
(2), (4) Date: Aug. 6, 2001

(87) PCT Pub. No.: WO00/46112

PCT Pub. Date: Aug. 10, 2000

(30) Foreign Application Priority Data

Feb. 4, 1999 (NZ) ..... 333884

(51) Int. Cl.[7] ..... B65D 43/26
(52) U.S. Cl. ..... 220/285; 215/305
(58) Field of Search ..... 220/284–286, 220/780, 793; 215/295, 302, 304, 305; 81/3.56, 3.37, 3.15

(56) References Cited

U.S. PATENT DOCUMENTS 1,818,732 A * 8/1931 McCutcheon ..... 220/285
1,948,513 A * 2/1934 Darling ..... 215/304
2,054,897 A * 9/1936 Darling ..... 220/285
2,135,731 A 11/1938 Podel
2,334,225 A 11/1943 Socke
2,895,630 A * 7/1959 Kraemar ..... 215/304
4,173,909 A * 11/1979 Cleveland et al. ..... 81/3.55
4,881,432 A * 11/1989 Olorenshaw et al. ..... 81/3.55

FOREIGN PATENT DOCUMENTS

IT 573174 2/1958
IT 690215 4/1965

* cited by examiner

*Primary Examiner*—Nathan Newhouse
(74) *Attorney, Agent, or Firm*—Young & Thompson

(57) ABSTRACT

A container (2) and closure (4) arrangement where the container includes a closure displacement lever (16) to assist a user with removal of the closure. The lever is pivotally connected to the container at one end (20) and the other end (18) is free for manipulation by a user. In use, a skirt of the closure sits over part of the lever, so that movement of the free end of the lever in a direction away from the container exerts a force on the skirt to facilitate removal of the closure from the container.

17 Claims, 3 Drawing Sheets

CONTAINER

TECHNICAL FIELD

This invention relates to a device used to aid the opening of a container. Specifically the present invention may be adapted to aid a user trying to open a container, and in some embodiments may include tamper evident features which provide an indication when the container has been tampered with.

Reference throughout this specification will also be made to the present invention being used to open paint pails. However, it should be appreciated by those skilled in the art that other applications (such as food containers) are envisioned for the present invention and reference to the above only throughout this specification should in no way be seen as limiting.

BACKGROUND ART

Containers that have tightly fitted lids have numerous uses in industrial applications. For example, in the paint manufacturing and retailing trade, containers with airtight and strongly engaged lids are essential to ensure that paint does not spoil through exposure to air, or spill easily if a container is dropped or knocked. Similar considerations apply to containers that carry foodstuffs, or chemicals.

As paint rims and lids need to engage tightly a screwdriver or other similar separate hand tool is usually required to open the container. Such tools are not always readily available to a user when a container needs to be opened, so it would be advantageous to provide the opening device as part of the container.

When using a hand tool such as a screwdriver, the end of the tool is inserted into the small gap between the rim and the lid, then pressure is applied to lever these two components apart. This may damage and destroy the tight seal between the rim and lid, thereby possibly allowing for air to degrade the container's contents over time. Opening the container with a hand tool can also destroy the tight engaging fit between the lid and rim, and again allow the contents of the container to spill if knocked or tipped over.

One attempt to address this problem is discussed in German Patent No. DE 3734051.

This patent specification describes an attachment or moulding formed as an integral part to the lid of the container. The additional moulding consists of handle that protrudes down from the lid to the side or sides of a container, and may be used to pull the lid off the container.

However, this type of device is relatively large and expensive to form within a lid. It is also unattractive and obtrusive when compared with other lid designs.

Some containers also benefit from the provision of a tamper evident means. These indicate when a container has been opened and hence tampered with. A tamper evident means can assure the end user that the paint they are buying has not been tampered with.

An improved container opening apparatus which solved any or all of the above problems would be of great advantage over the prior art. Specifically a lid opening device that could be used easily to open a container, which could be formed at a relatively low cost, which provided tamper evidence and which incorporated an attractive design would be of advantage over the prior art.

It is an object of the present invention to provide a container and closure arrangement that will address the foregoing problems or at least to provide the public with a useful choice.

Further aspects and advantages of the present invention will become apparent from the ensuring description which is given by way of example only.

DISCLOSURE OF INVENTION

According to one aspect of the present invention there is provided a container and closure therefor; the container including a base, a rim surrounding an opening to the container, at least one circumferential wall extending from the base to the rim, a closure displacement lever having a connected end and a free end, the connected end being connected to the out side of the circumferential wall at or below the rim, the free end being capable of manipulation by a user to pivot the lever about the connected end;

the closure including container engagement means to engage with the rim of the container in use, and a skirt projecting below the container engagement means, a lower edge of the skirt being located adjacent to the lever and whereby movement of the free end of the lever facilitates removal of the closure.

According to yet another aspect of the present invention there is provided a method of operating a container substantially as described above.

According to yet another aspect of the present invention there is provided a method of removing a closure from a container, the container having a base, a rim surrounding an opening to the container, at least one circumferential wall extending from the bass to the rim, a closure displacement lever pivotally connected to the rim or to a part of the circumferential wall adjacent to the rim, the method comprising the steps of pivoting the lever about the pivotal connection to disengage at least a part of the closure from the container, and removing the remainder of the closure from the container.

In a preferred aspect the free end of the lever is located below the connected end, and the lower edge of the skirt is located below the connected end of the lever when the closure is engaged with the container.

In a preferred aspect the relative positions of the connected end, the container engagement means and the lower edge of the skirt are such that initial movement of the free end of the lever away from the circumferential wall results in a substantial outward movement of the lower edge of the skirt away from the circumferential wall to facilitate disengagement of the container engagement means.

In another preferred aspect further movement of the free end about the connected end results in an upward movement of the skirt to facilitate separation of the closure from the container.

In another preferred aspect a frangible connection is provided between the container and the lever, whereby movement of the fever in use breaks the frangible connection.

a flange is provided surrounding the circumferential wall closely adjacent to the lower edge of the skirt, and the lever forms part of the flange.

In another preferred aspect the flange is discontinuous at either side of the lever, and the lever conforms to the shape of the flange.

In another preferred aspect the flange includes an upwardly projecting peripheral wall, which extends above the lower edge of the skirt.

According to yet another aspect of the present invention there is provided a container that includes a tamper evident means that indicates when the container has been opened.

A container configured in accordance with the present invention may be any device or apparatus that is adapted to contain a volume of material. Such a container may be constructed from metal, plastic, wood or other any material that is useful in the particular application required for the container.

A container configured in accordance with the present invention may be a variety of shapes.

Reference throughout this specification will also be made to the container being formed from moulded plastic, and being of a generally cylindrical shape. However, it should be appreciated by those skilled in the art that other materials and shapes may be used in the construction of the present invention and reference to the above only throughout this specification should in no way be seen as limiting.

In a preferred embodiment a container includes a body which is adapted to contain a volume of material. The body of the container allows it to perform its main function by holding or retaining a volume of material in place.

In a preferred embodiment a body may be adapted to contain a volume of paint. This application for the invention allows it to be used to contain volumes of paint in a sturdy, secure and airtight apparatus.

Reference throughout this specification will also be made to the present invention being adapted to contain paint. However, it should be appreciated by those skilled in the art that a container configured in accordance with the present invention may be used to contain other materials if required. For example, in other embodiments a container may be adapted to contain oil, cereal grains, medical powders, food products, ointments, dairy products or any other number of different types of materials if required.

In a preferred embodiment the body may be formed into any shape with side walls, a closed bottom end and an open top end. The body may be configured as a cylinder, cube or any other shape that may be used as an effective container. This shape may form the basis of a pail or tub, which is commonly used to store and contain paint.

In a preferred embodiment the container includes a rim which may be defined as the top edge or surface at or adjacent to the open end of the container.

In a preferred embodiment the present invention includes a closure. The closure may be adapted to engage with the rim of a container to close and seal the container. Both the closure and the container may include specifically moulded or shaped flanges, protrusions, or edges to allow these two elements to be removably engaged to each other. Those skilled in the art should appreciate that known technology may be used to this aim and as such will not be described in detail in the specification.

This configuration of the invention's closure ensures that there will be a tight fit between the two elements once they are engaged together. The connection between the lid and the rim may also be strong enough to prevent the user from easily opening the container with their bare hands.

In a preferred embodiment the present invention includes a lever. A lever may be defined as any type of element or apparatus that may be used to disengage the closure from the rim.

In a preferred embodiment the lever may be formed as an integral part of the container. In such an embodiment the container and lever may be moulded and formed as a single integral component, thereby simplifying the manufacture of the apparatus and also substantially reducing its overall cost.

Reference throughout this specification will now be made to the lever being integrally moulded into the container. However, it should be appreciated by those skilled in the art that other configurations to the present invention are envisioned and reference to the above only throughout this specification should in no way be seen as limiting.

In a preferred embodiment the lever may be pivoted through an arc to disengage the closure from the container. By pivoting the lever it can apply a torque or turning force on an edge of the closure and thereby force one end of the closure off the container. A levering advantage will be provided by the user placing force on the and of a lever and pivoting same. It is envisaged that the lever could be of any practical length.

Reference throughout this specification will also be made to the lever being pivoted to disengage the closure from the container. However, it should be appreciated by those skilled in the art the other movements of the lever may be used to disengage these two components and reference to the above only throughout this specification should in no way be seen as limiting.

In a preferred embodiment the lever may include a projecting bar. This bar may project from the container and have a free and and a connected end. The free end may project away from the container while the connected end may be connected to a section of the container or circumferential wall. In a further preferred embodiment the connected and of the projecting bar may be pivotably connected to the container or circumferential wall. This may be accomplished by using a specific thickness of plastic or type of plastic to engage the two elements together. Those skilled in the art should appreciate that numerous different known methods of manufacture may be used to achieve this particular aim and as such have not been discussed in detail in this specification.

In a preferred embodiment the connected end of a projecting bar may be connected to the rim or the body at a point both vertically and laterally displaced from the position of the free end of the projecting bar. In such an embodiment the pivotal connection of the bar to the rim or body ensures that when the lever is pivoted, it places both a vertical and horizontal force on to a lid, thereby pushing the lid upwards as wed as sideways off the rim.

In a preferred embodiment the present invention may be adapted to provide a tamper evident means to indicate when the container has been opened. In such an embodiment this tamper evident means provides the eventual user with some assurances as to whether their purchase has been tampered with or damaged through exposure to air.

In a preferred embodiment the integral moulding of the lever to the container may provide a tamper evident means to the container. As these two components are moulded from a single piece, the integral connections between the container and either side of the lever will at least in part engage the lever with the container. If a person wishes to use the lever to open the container, they must sever or break these connecting areas and hence show that the container has been tampered with.

In a preferred embodiment the sides of the lever may be connected to the container through sections of relatively thin or weak plastic when compared to the plastic used in the construction of the lever or adjacent areas of the container such as the flange. These plastic sections may be perforated or continuous so as to be easily broken or torn if someone wishes to move the lever away from its original position.

In a preferred embodiment the closure and container may be adapted to removably engage with one another so that the lid cannot be removed from the container without the use of some sort of levering tool—be it integrated into the container or a separate component such as a screwdriver. In such an embodiment of a hand tool may also cause damage to the container as it is used to lever the closure off and hence again show that the container has been tampered with. The fit between the closure and the container may be such that as there is a very little space between these two components there is a high likelihood of damage occurring to either one if such a hand held levering tool is used.

In a preferred embodiment the container may also include a substantially horizontal projecting flange in the area of the circumferential wall where the bottom edge of the closure is located in use. The provision of such a flange or ledge in this position makes it relatively difficult for someone to gain access to the bottom of the closure. The flange or ledge provided on the container stops a screwdriver or other hand tool being easily inserted into the gap between the container and the closure. If a screwdriver or other hand tool is used by someone to gain access to the bottom of the closure, the projecting flange will very probably be deformed, showing that the container has been tampered with.

In a further preferred embodiment the flange may also include a substantially horizontal projection or ledge similar to that discussed above, which also includes a channel. The ledge may be positioned and configured so that when a lever is used, the channel causes the ledge to deform and bend through an angle. This feature of the invention provides the container with an additional tamper evident means, as any prospective customer can clearly see if a container has been tampered with if this horizontal ledge or flange is bent out of shape.

The present invention may provide some significant advantages over existing containers.

A container configured in accordance with the present invention may be easily opened by the user with their bare hands. With the present invention there is no need for someone to use an additional tool such as a screwdriver or a knife to force a closure off the rim.

The present invention may also be adapted to provide a tamper evident means to alert the user if the container has been interfered with.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

The invention consists in the foregoing and also envisages constructions of which the following gives examples.

BRIEF DESCRIPTION OF THE DRAWINGS

Further aspects of the present invention will become apparent from the following description which is given by way of example only and with reference to the accompanying drawings in which.

BEST MODES FOR CARRYING OUT THE INVENTION

Figure 2:
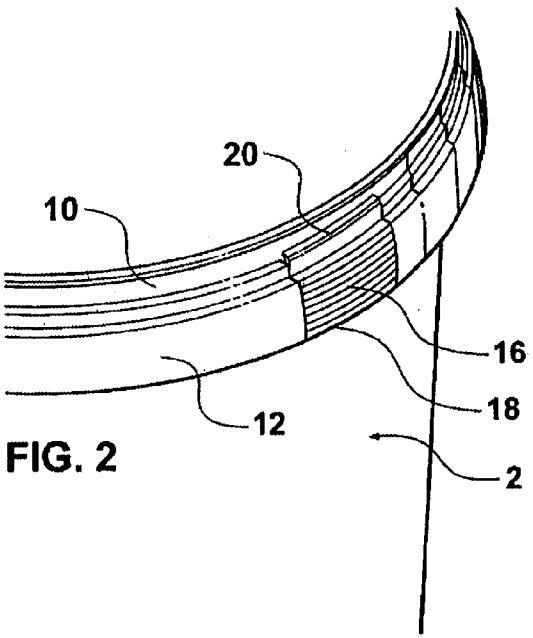
FIG. 2 shows a view of a container body, rim, lid and lever with no lid in place configured in accordance with an embodiment of the present invention.
Figure 1:
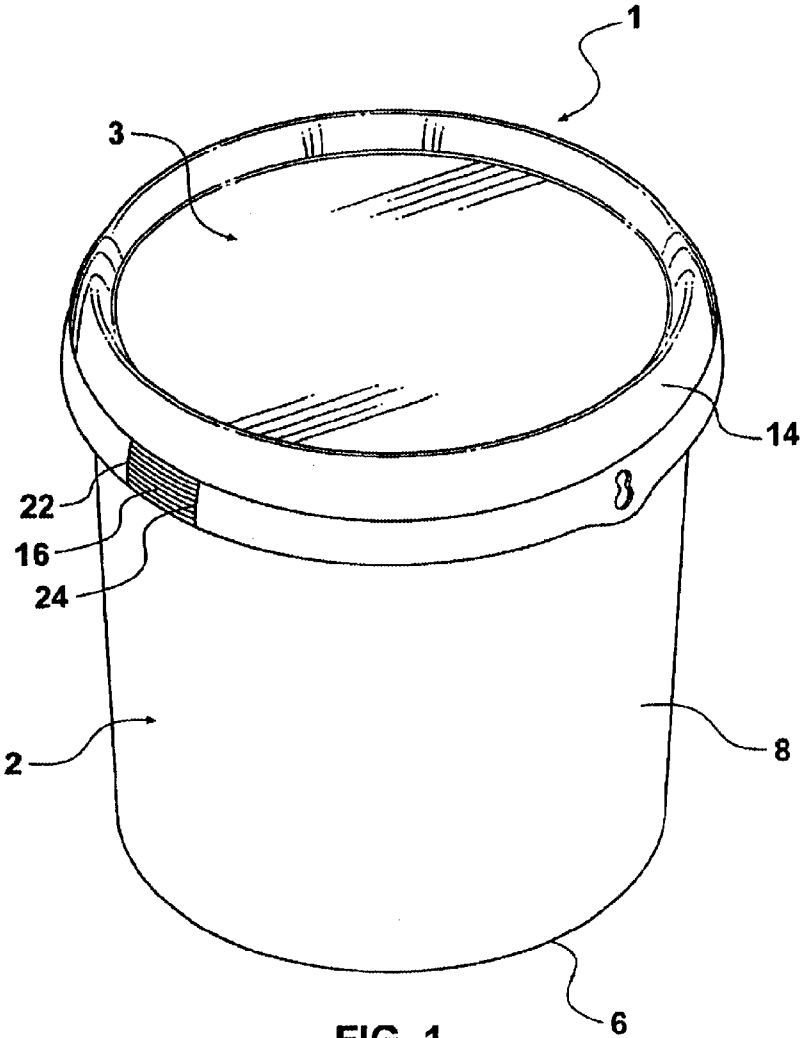
FIG. 1 shows a container with the lid on configured in accordance with one embodiment of the present invention.

FIGS. 1 and 2 show a container configured in accordance with one embodiment of the present invention.

These figures show a container, generally referenced 1 that includes a body generally referenced 2 adapted to contain a volume of material (which in this embodiment is paint). As shown in FIG. 1, de container also includes a lid or closure generally referenced 3 that is configured so as to be removably engaged with the top of the body 2. Paint may be securely stored within the container 1 when the lid 4 is placed upon the body 2 and engaged therewith.

The body 2 generally comprises a base 6, an upper rim 10 that defines an opening to the container, and a sidewall 8 between the base and the rim. In the embodiment illustrated there is a single substantially cylindrical circumferential wall, but it will be seen that the container could be provided in other shapes, so a plurality of sidewalls could be provided.

A flange 12 is provided below the rim, and in the embodiment shown the flange is contoured to make a close fit with at least the lower edge of a skirt 14 of the closure.

The container 1 also includes a lever 16 attached to the circumferential wall in an area adjacent to the rim and preferably between the flange and the rim. In the embodiments shown the lever is attached to the container by being moulded as an integral part thereof. The lever 16 is configured from a projecting bar mat has a free end 18 that may be grasped and manipulated by a user, and a connected end 20 that is connected to the circumferential wall of the container.

FIGS 1 and 2 also show how the container 1 can be provided with a tamper evident means. As in these embodiments the free end of lever 16 is configured as an integral part of the flange 12, each of the side edges 22 and 24 of the lever 16 is connected to the flange via a relatively weak strip or length of plastic. When the lever 16 is used to open the container these connecting strips are severed, thereby indicating that the container has been tampered with.

Figure 3:
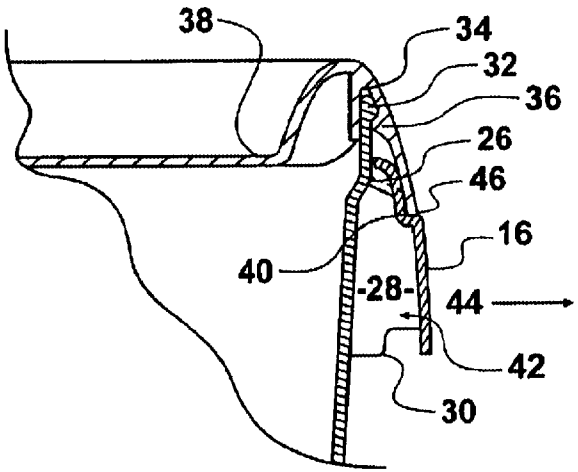

FIG. 3 shows a cross sectional side view of part of the container and closure configured in accordance with FIG. 1. As can be seen from FIG. 3, the body of lever 16 substantially coincides with the flange 12 and may be formed as an integral part thereof. The connected end 20 of the lever is connected to the wall above the upper edge 26 of the flange, but may be connected at the same point as the upper edge 26 if desired. The lever is preferably, but not necessarily, moulded as an integral part of the container and flange and the connection between the lever and the wall of the container is formed by a weakened bridge of geometric form sufficient to allow pivotal movement despite being attached to the curved wall of the container.

The connected end 20 of the lever is connected to the wall at a point substantially laterally and vertically offset to the free end 18. The connection of the lever to the rim at the connected end 20 is configured so that the lever may be pivoted upwards using the connected end 20 as a pivot point.

The flange is supported relative to the wall by ribs 28 that have a profiled lower edge to assist stacking empty containers. The lower edge 30 prevents the rim of a lower empty container from becoming jammed underneath the flange 12.

The rim 10 includes an outwardly projecting bead 32 for engaging with the closure as described further below.

The closure has an inverted channel 34 that locates over the rim 10 in use. A lower edge of the channel 34 includes an inwardly projecting bead 36 that is designed to fit under the bead 32. The arrangement in use holds the closure in a firm sealing engagement with the container.

The flange 12 includes a recess 40 into which the skirt 14 fits closely. The close fit makes it difficult to use a tool such as a screwdriver to prise off the lid, particularly without causing visible damage to the adjacent surfaces.

The operation of the lever will now be described. As can be seen from FIG. 3, there is a space generally referenced 42 between the wall and the free end of the lever. A user may insert a finger (or a tool if desired) into space 42 to pull the free end substantially laterally away from the wall in the direction indicated by arrow 44. This causes the free end of the lover to pivot about the connected end. The movement is illustrated in FIG. 4.

Figure 4:
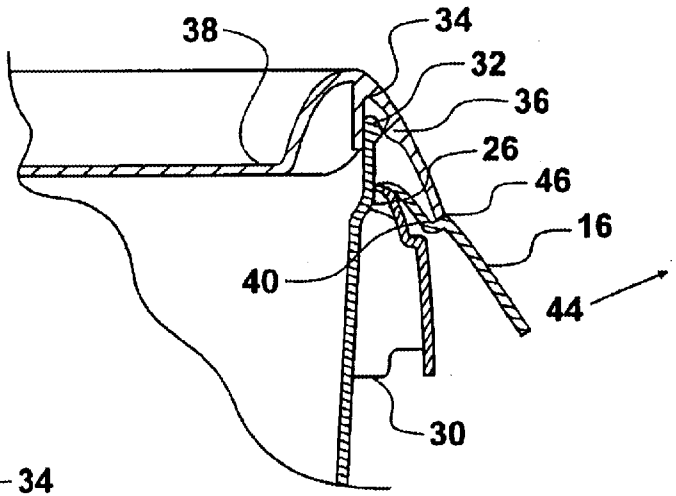
FIGS. 3–5 show partial cross sectional views of one side of the container shown in the preceding figures from a closed position to a position where the closure is substantially removed from the container.

Turning to FIG. 4, the initial movement of the lever causes the body of the lever to contact the lower edge 46 of the skirt 14, pulling the skirt away from the flange. This in turn causes the bead 36 to be pulled away from bead 32 to disengage the nearby area of the closure from the rim.

Figure 5:
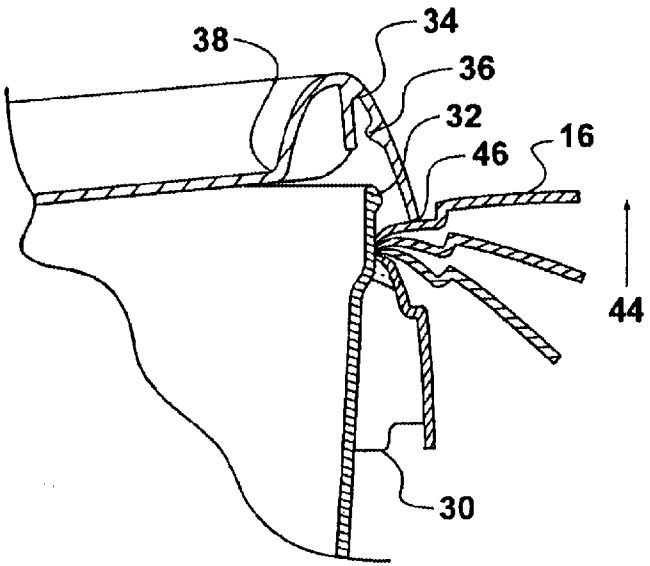

Turning now to FIG. 5, further rotation of the lover eventually causes a substantially vertical movement causing the skirt to be lifted, which lifts the closure, or at least the area of the closure near the lever, from the rim.

It will be seen that the design of the lever provides the advantage that the closure engagement (beads 32 and 36) are disengaged first, then the closure is pushed upwardly for removal. Disengagement of the beads 32 and 36 assists removal of the closure, since the force required to lift the closure by dragging bead 36 past bead 32 is much greater than that required if bead 36 is firstly pulled out past bead 32.

A significant advantage provided by the lever is that the lever is designed to remain attached to the container i.e. the lever does not add to the waste stream.

To enable the lever to work by means of a pulling action i.e. pulling the skirt away from the container, the connected end is best provided above the lower edge of the skirt. The connected end may be provided at any position above the skirt that sill enables the lever to function. However, we have found that the action of the lever to initially pull the skirt outwardly away from the container is assisted by the connected end of the lever being provided at least as high as approximately mid-way or between the lower edge of the skirt and the closure engagement bead. This arrangement allows a substantial initial lateral outward motion away from the container before the pivoting motion of the lever begins a substantial vertical upward motion.

It will be seen that the lever could be arranged in other ways. For example, although not shown in the drawings, the lever could be pivotally connected at some midpoint to one or more of the support ribs, so that a force on the base of the lever in a direction toward the circumferential wall will cause the upper part of the lever to push the skirt outwardly to facilitate disengagement.

Figure 7:
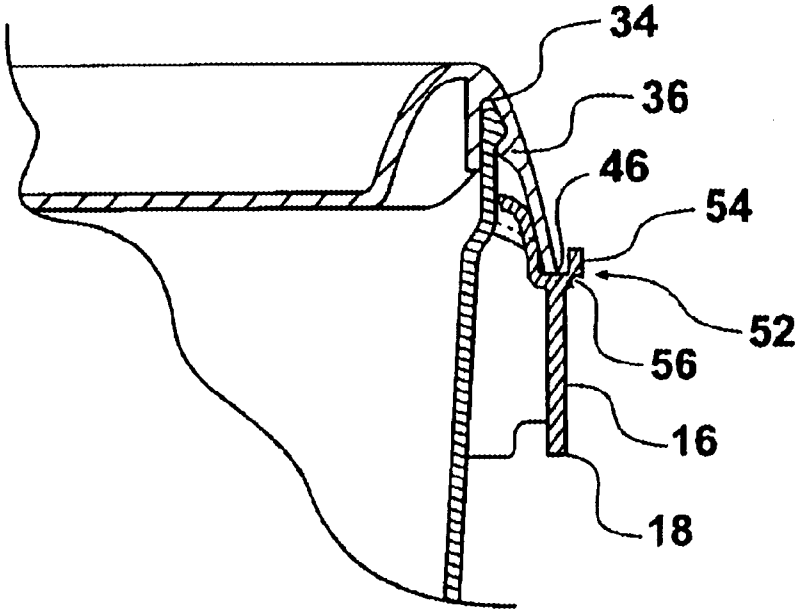
FIG. 7 shows a container configured in accordance with yet another embodiment of the present invention again showing further tamper combating features.
Figure 6:
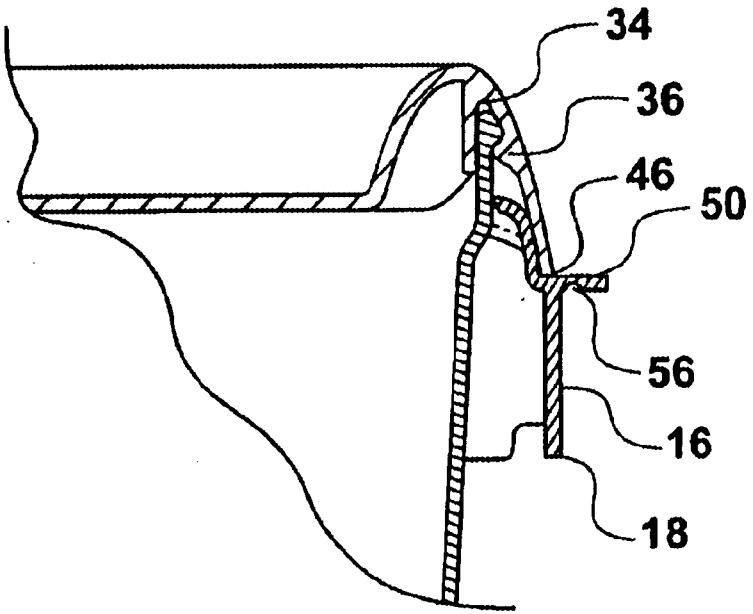
FIG. 6 shows a container configured in accordance with another embodiment of the present invention with further tamper combating features.

FIGS. 6 and 7 show a container configured in accordance with yet another embodiment of the present invention.

Features of the embodiments shown in FIGS. 6 and 7 that correspond to the same or similar features in the foregoing embodiments have the same reference numerals.

FIG. 6 shows a container configured in accordance with another embodiment of the present invention. The container shown is substantially similar to that discussed with respect to the preceding figures but differs in the fact that the flange 12 also includes a substantially horizontally projecting ledge 50.

The ledge 50 is adapted to interfere with or partially cover the interface between the skirt lower edge 46 and the rim flange. The ledge 50 makes it relatively difficult for anyone to place a hand tool such a screwdriver between the lid and the rim thereby reducing the chances of anyone being able to tamper with the container without leaving some evidence of such activity.

The container shown in FIG. 7 includes a channelled section 52 on the flange to capture the lower edge 46 of the closure skirt. The substantially vertical section 54 limits access to the lower edge 46 of the skirt, making it difficult to remove the closure without using the lever.

In the embodiments of FIGS. 6 and 7, an area of weakening 56 may be provided in the ledge 50 or in the base of channelled section 52. This allows the ledge 50 or the vertical section 54 in the vicinity of the lever to be bent or broken away in use. Thus, as the lever is lifted, the lower edge of the closure skirt may ride down the body of the lever without being substantially impeded by the ledge or by the vertical section 54.

Aspects of the present invention have been described by way of example only and it should be appreciated that modifications and additions may be made thereto without departing from the scope thereof.

What we claim is:

1. A container and closure therefor, comprising:

a container comprising:

a base;

a rim surrounding an opening to the container;

at least one circumferential wall extending from the base to the rim; and a closure displacement lever integrally molded into the container having a connected end and a free end, the connected end being connected to the outside of the circumferential wall at or below the rim, the free end being capable of manipulation by a user to pivot the lever about the connected end; and a closure comprising:

a container engagement means to engage with the rim of the container in use; and a skirt projecting below the container engagement means, a lower edge of the skirt being located adjacent to the lever and wherein movement of the free end of the lever facilitates removal of the closure.

2. The container as claimed in claim 1, wherein the container includes a tamper evident means that indicates when the container has been opened.

3. The container as claimed in claim 2, wherein the tamper evident means includes a frangible connection provided between the container and the lever, wherein movement of the lever in use breaks the frangible connection.

4. The container and closure as claimed in claim 1, wherein the sides of the lever may be connected to the container through sections of relatively thin plastic.

5. The container and closure as claimed in claim 4, wherein the sections can be selected from the group comprising perforated and continuous sections.

6. The container and closure as claimed in claim 1, wherein the flange is discontinuous at either side of the lever and the lever conforms to the shape of the flange.

7. The container and closure as claimed in claim 1, wherein the lever is provided with a recess into which the skirt fits closely.

8. The container and closure as claimed in claim 1, wherein the flange is provided surrounding the circumferential wall closely adjacent to the lower edge of the skirt, and the lever forms part of the flange.

9. The container and closure as claimed in claim 8, wherein the flange includes a ledge and an upwardly projecting peripheral wall, which extends from the ledge above the lower edge of the skirt.

10. The container and closure as claimed in claim 9, wherein an area of weakness is provided in the ledge, said area of weakness being in the vicinity of the upwardly projecting peripheral wall in the vicinity of the lever and said area of weakness being selected from the group comprising bending and breaking away.

11. The container and closure as claimed in claim 8, wherein the flange includes a substantially horizontally projecting ledge.

12. The container and closure as claimed in claim 11, wherein the ledge is adapted to interfere with the interface between the skirt and the flange.

13. The container and closure as claimed in claim 11, wherein an area of weakness is provided in the ledge, said area of weakness being in the vicinity of the lever and said area of weakness being selected from the group comprising bending and breaking away.

14. A method of removing a closure from a container, the container having a base, a rim surrounding an opening to the container, at least one circumferential wall extending from the base to the rim, a frangible connection provided between the container and the lever, a closure displacement lever pivotally connected to the rim or to a part of the circumferential wall adjacent to the rim, the method comprising the steps of:

pivoting the lever about the pivotal connection to break the frangible connection followed by pivoting the lever about the pivotal connection to disengage at least part of the closure from the container, and removing the remainder of the closure from the container.

15. A container and closure therefor, the container comprising:

a base;

a rim surrounding an opening to the container;

at least one circumferential wall extending from the base to the rim;

a closure displacement lever having a connected end and a free end, the connected end being connected to the outside of the circumferential wall at or below the rim, the free end being capable of manipulation by a user to pivot the lever about the connected end;

the closure comprising:

container engagement means to engage with the rim of the container in use; and a skirt projecting below the container engagement means, a lower edge of the skirt being located adjacent to the lever and whereby movement of the free end of the lever facilitates removal of the closure, wherein a flange is provided surrounding the circumferential wall closely adjacent to the lower edge of the skirt, and the lever forms part of the flange.

16. The container and closure as claimed in claim 15, wherein the flange is discontinuous at either side of the lever, and the lever conforms to the shape of the flange.

17. The container and closure as claimed in claim 15, wherein the flange includes an upwardly projecting peripheral wall, which extends above the lower edge of the skirt.

* * * * *